United States Patent [19]

Sessler et al.

[11] Patent Number: 4,675,906

[45] Date of Patent: Jun. 23, 1987

[54] SECOND ORDER TOROIDAL MICROPHONE

[75] Inventors: Martin Sessler, Darmstadt, Fed. Rep. of Germany; James E. West, Plainfield, N.J.

[73] Assignee: AT&T Company, AT&T Bell Laboratories, Murray Hill, N.J.

[21] Appl. No.: 684,574

[22] Filed: Dec. 20, 1984

[51] Int. Cl.[4] ..... H04R 1/32; H04R 1/20; H04R 1/40

[52] U.S. Cl. ..... 381/92; 381/88; 381/169; 381/188

[58] Field of Search ..... 381/86, 87, 88, 92, 381/122, 152, 153, 154, 155, 158, 159, 160, 168, 169, 188, 205; 367/129, 188; 179/121 D, 146 R, 179; 181/153, 158, 171, 179

[56] References Cited

U.S. PATENT DOCUMENTS

| | | | |
|---|---|---|---|
| 2,539,671 | 1/1951 | Olson | 179/138 |
| 2,563,010 | 8/1951 | De Boer et al. | 381/155 |
| 3,573,399 | 4/1971 | Schroeder | 179/121 D |
| 3,573,400 | 8/1968 | Sessler et al. | 381/155 |
| 4,420,655 | 12/1983 | Suzuki | 381/94 |
| 4,436,966 | 3/1984 | Botros | 179/121 D |
| 4,589,137 | 5/1986 | Miller | 381/94 |

OTHER PUBLICATIONS

"Second-Order Gradient Unidirectional Microphones Utilizing an Electret Transducer", by G. M. Sessler and J. E. West, *J. Acoust. Soc. Am.*, vol. 58, No. 1, Jul. 1975, pp. 273-278.

*Primary Examiner*—Gene Z. Rubinson
*Assistant Examiner*—Danita R. Byrd
*Attorney, Agent, or Firm*—Patrick E. Roberts

[57] ABSTRACT

A second order gradient microphone arrangement is implemented with four commercially available, inexpensive first order gradient electret microphones which are arranged in the wall of a hollow cylinder at ninety degrees angular spacings and whose outputs are added to produce a toroidal directional characteristic. The distance between the tops of the microphones and the top of the cylinder equals the distance between the bottoms of the microphones and the bottom of the cylinder. The directional characteristic is relatively frequency independent. The arrangement is characterized by rotational symmetry around the cylinder axis and further by a cosine squared dependence in the planes containing the rotational axis. In the direction of the axis, the sensitivity at midfrequencies is typically twenty decibels lower than in the equatorial plane. The equalized frequency response in this plane is within ±3 dB from 0.3 to 3 kHz.

9 Claims, 13 Drawing Figures

SECOND ORDER TOROIDAL MICROPHONE

TECHNICAL FIELD

This invention relates to electroacoustic transducers and, more particularly, to a directional electroacoustic microphone with a toroidal sensitivity pattern.

BACKGROUND OF THE INVENTION

In many applications, microphones with uniformly high sensitivity in directions within an "equatorial" plane and low sensitivity in the direction perpendicular to this plane, that is, along the "polar" axis, are desired. An example is conference telephone, where the microphone should receive the voices of participants seated around a table with uniformly high sensitivity while discriminating against sound reflected from ceiling and table top as well as sound from an overhead loudspeaker.

Such "toroidal" microphones are designed in the prior art using a variety of principles. For example, a transducer comprising two first order gradients, arranged at right angles, whose outputs are added in quadrature phase is disclosed in U.S. Pat. No. 2,539,671 issued Jan. 30, 1951 to H. F. Olson. Another example is a transducer comprising two second order gradients also arranged at right angles, whose outputs are added directly as disclosed by G. M. Sessler et al in a paper which was published in 1971 in the IEEE Transaction on Audio and Electroacoustics, volume AU-19, at page 19. While the former principle yields only a cosine shaped directivity pattern in the polar plane but requires a broadband ninety degree phase shifter, the latter design delivers the more desirable cosine squared characteristic and requires no phase network. In its original implementation, the cosine squared system was difficult to balance acoustically and had a relatively poor signal to noise performance. A new implementation of the second order toroidal microphone is desirable which avoids the shortcomings of the former design.

SUMMARY OF THE INVENTION

A plurality of first order gradient microphones are symmetrically arranged in openings through the wall of a hollow cylindrical baffle so that the angular spacings between any two microphones in the equatorial plane (perpendicular to the axis of the cylinder) is the same. The distance between the tops of the microphones and the top of the cylinder equals the distance between the bottoms of the microphones and the bottom of the cylinder. When the signals from the microphones are summed, a toroidal directional characteristic which is relatively frequency independent is obtained.

The arrangement produces a second order gradient microphone which is characterized by rotational symmetry around the cylinder axis and by a cosine squared dependence in the planes containing the rotational axis. In the direction of the axis, the sensitivity at midfrequencies is typically twenty decibels lower than in the equatorial plane. The equalized frequency response in the equatorial plane is within $\pm 3$ dB from 0.3 to 3 kHz.

This arrangement has many advantages over the prior art from the use of miniature first order pressure gradient transducers and from the use of a cylindrical baffle in which the microphones are housed. Because signal subtraction is done internally with pressure gradient transducers, a separate signal subtaction circuit is unnecessary. The low cost of pressure gradient microphones which may be purchased off the shelf makes the toroidal microphone inexpensive.

The cylinder increases the effective spacing between the inner and outer surfaces of each microphone because a sound signal would have to diffuse from the outer surface up or down the cylinder outer wall over the edge and down or up the cylinder inner wall, respectively, to the inner surface of the microphone. Thus, the physical size of this system is small compared to a linear system. This directly increases the sensitivity of the system without introducing undesirable side effects.

Because the cylinder causes the generation of circumferential waves, it makes the equatorial response of the system more uniform. Thus, even for only two operating gradient microphones or for gradient microphones with large sensitivity differences, a uniform equatorial response is obtained.

Because of a build up of pressure on its outer surface, the cylinder also boosts the sensitivity in the mid and high frequency range relative to an unbaffled system. This causes the gradient microphones to work partially as pressure units. Thus, additional signal to noise margin is gained in this frequency range.

By increasing the height of the cylinder, the directional response is sharpened beyond the cosine squared dependence with a concomitant additional boost in the mid and high frequency ranges.

Because of these favorable properties, the toroidal microphone is believed to be suitable for a wide variety of applications.

DETAILED DESCRIPTION

Figure 1:
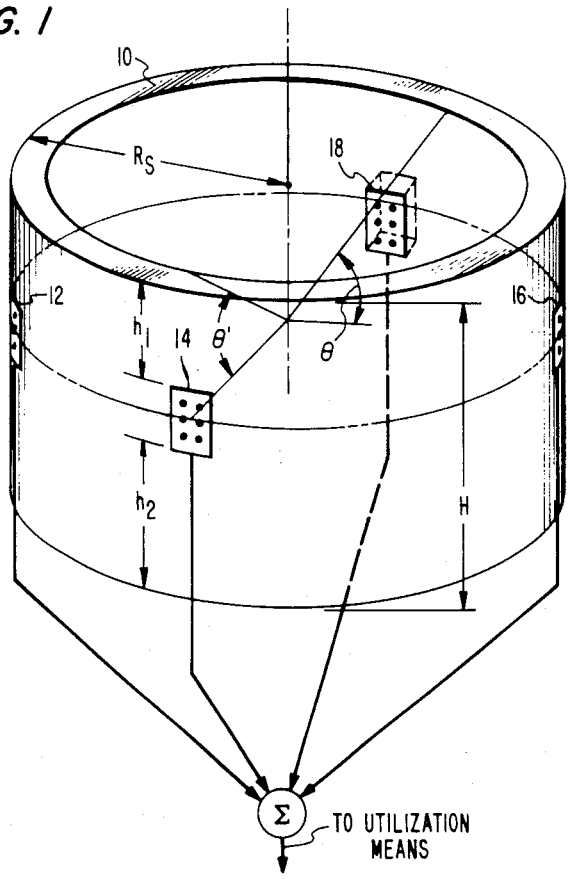
FIGS. 1 and 2 show different views of the toroidal microphone embodying the present invention.
Figure 2:
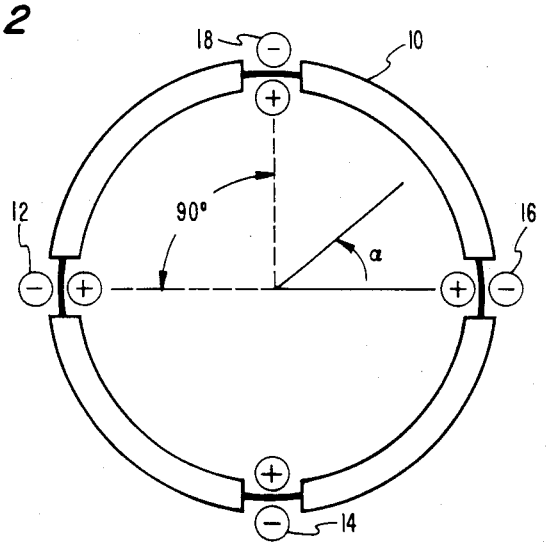

FIGS. 1 and 2 are useful in disclosing the principles of this invention. Four first order gradient microphones 12, 14, 16 and 18 which are bidirectional are placed in openings of the wall of a hollow plastic cylinder 10 halfway between the top and bottom. That is, the distance $h_1$ between the top of cylinder 10 and the top of each microphone is the same as the distance $h_2$ between the bottom of each microphone and the bottom of cylinder 10. The microphones are spaced, furthermore, ninety degrees apart in the horizontal midplane. The individual microphones are arranged symmetrically with respect to their phase response. That is, the phase seen from inside the cylinder is the same for each unit. Leaks between each of the microphones and cylinder 10 are sealed. The output voltages of the four transducers are electrically added using known techniques.

Figure 3:
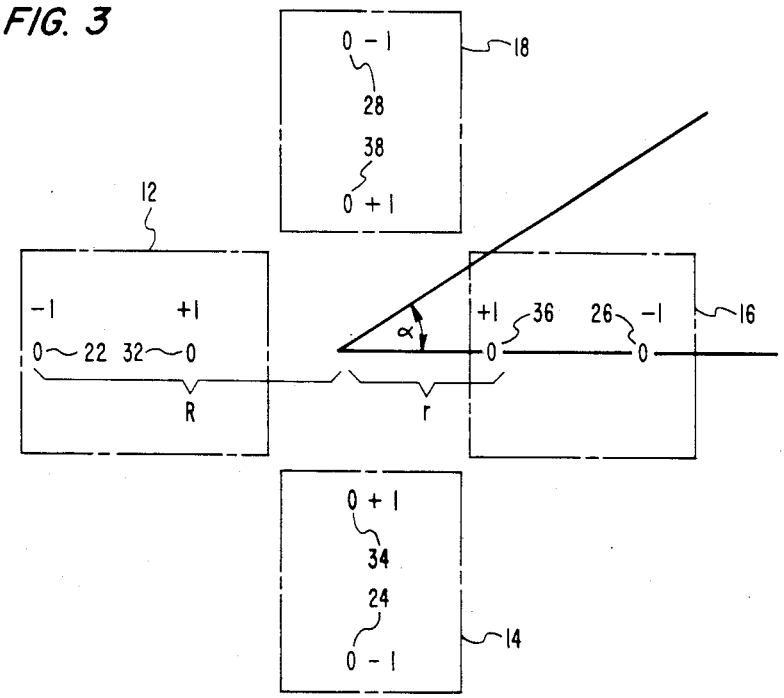
FIG. 3 is a conceptual arrangement of the microphones of FIG. 1.

The transducer design is based on the simple geometry of a second order toroidal microphone comprising eight sensors 22 through 28 and 32 through 38 as shown in FIG. 3. Each of the bidirectional microphones is shown as two separate sensors. Thus, microphone 12 is shown as two sensors 22 and 32. The inner sensors 32 through 38, representing the inner faces of the microphones 12 through 18, are each spaced a distance r from the center of the cylinder 10 of FIG. 1 and the outer sensors 22 through 28, representing the outer faces of the microphones 12 through 18 are spaced a distance R from the center of cylinder 10.

The sensitivity of such a microphone to a plane sound wave is related to the sensitivity $M_0$ of a sensor assumed to be positioned in the center of the arrangement. This is disclosed by G. M. Sessler et al in a paper published in 1969 to be found in volume 46 of Journal of the Acoustic Society of America at page 28. The sensitivity M is given by the expression $$M=2M_0[\cos(kr\sin\alpha\cos\theta)+\cos(kr\cos\alpha\cos\theta)-\cos(kR\sin\alpha\cos\theta)-\cos(kR\cos\alpha\cos\theta)] \quad (1)$$

where r, R, and $\alpha$ are defined in FIG. 3, k is the wave number and $\theta$ is the angle of incidence of the sound wave on the plane of the sensors.

An evaluation of equation (1) shows that the sensitivity rises proportionally with $k^2=(\omega/c)^2$ at low frequencies but oscillates between maximum and zero values at higher frequencies. The behavior at low frequencies can be seen by assuming the term $kR\cos\theta$ to be much less than one and simplifying equation (1) to obtain $$M=M_0(k\cos\theta)^2(R^2-r^2) \quad (2)$$

Thus, the response is independent of the azimuthal angle $\alpha$ and proportional to $(\cos\theta)^2$.

The extreme of the frequency response of M is obtained using the following analysis. Assuming the sound wave to impinge from the direction $\alpha=0$, $\theta=0$, the sensity follows from equation (1) as $$M=2M_0(\cos kr-\cos kR) \quad (3).$$

The extreme of this function is given by $$r\sin kr=R\sin kR \quad (4).$$

The transducer shown in FIGS. 1 and 2 differs from the scheme shown in FIG. 3 in the sense that diffraction at cylinder 10 modifies the complex sound pressure at the openings of the individual microphone surfaces. In particular, diffraction at an infinitely long (that is, the height of cylinder 10 is infinitely long), rigid or soft cylinder results in circumferential or creeping waves which circle the cylinder while being attenuated. The phase velocity of these waves is given by $$c-c_0[1+\tfrac{1}{2}\,6^{-(\frac{1}{3})}(ka)^{-(\frac{2}{3})}q_n]^{-1} \quad (3)$$

where $c_0$ is the sound velocity in free space, k is the wave number, a is the radius of the cylinder and $q_n$ is defined by $$q_n=3\left[\frac{\pi}{2}(n-\tfrac{1}{4})\right]^{\frac{2}{3}} \quad (6)$$

where n=1, 2, 3 . . . The circumferential waves are thus dispersive.

The more complicated geometry of a hollow cylinder of finite height used in the microphone arrangement of the present invention has, to the knowledge of the authors, not been discussed in the literature. The measurements to be discussed hereinbelow indicate, however, a severe modification of the sound field by diffraction, in this case, resulting in corresponding changes of the directional response of each individual first order gradient microphone. Yet, under certain conditions, the combined response of four gradients is found to correspond closely to that of the ideal system shown in FIG. 2 and mathematically described in equations (1) and (2).

In one embodiment of the present invention, the microphone arrangement of FIG. 1 having toroidal response pattern is made up of four first order gradient microphones, such as the Knowles model BW-1789, of size $8\times4\times2$ mm$^3$, or a gradient version of the ATT-Technologies EL-3 electret condenser microphone. These microphones are placed in openings of the wall of a hollow PLEXIGLASS cylinder of $2R_s=5$ cm outer diameter and 5 mm wall thickness. The gaps between the microphones and the PLEXIGLASS are sealed with epoxy. Two such toroidal microphones were built with cylinder heights of H=5 cm and H=15 cm.

The radius of the cylinder was chosen such that the maximum of the frequency response is located beyond the upper end of the frequency range of interest. When using equation (4) as an approximation of the present case, effective values of the radii R and r have to be known. Assuming diffraction takes place primarily around the upper and lower edges of cylinder 10, one estimates for the cylinder of 5 cm height for sound incident at $\alpha=\theta=0$ effective spacings, $$2R=2R_s+\frac{H}{2}=7.5\text{ cm},$$

and $$2r=\left[4R_s^2+\left(\frac{H}{2}\right)^2\right]^{\frac{1}{2}}-\frac{H}{2}=3.1\text{ cm},$$

where $R_s$ is the outer diameter of the cylinder and H is the height of the cylinder. Assuming, alternatively, the diffracted wave to be a circumferential wave having a velocity given by equation (5), the effective spacing at 4 kHz follows as 2R=8.8 cm.

The height of the cylinder determines the additional shaping of the frequency response beyond the $\omega^2$ dependence imposed by equation (1). This is due to the fact that, with increasing height and increasing frequency, the inner sensors 32 through 38, that is, the microphone openings on the inner cylinder wall, are more shaded. The pressure gradient microphones will therefore have a pressure sensitive component which increases with the height of the cylinder and with frequency. Compared to a pressure gradient microphone, the sensitivity will thus be boosted at the higher frequencies.

Measurements on the toroidal microphone were carried out in an anechoic chamber. The microphone was mounted on a B & K turntable and exposed to a sound field. A PAR model 113 pre-amplifier was used to amplify the microphone output. The results were plotted with a B & K level recorder.

To investigate the effects of diffraction around the cylinder on the response of the microphone, measurements with one, two, and all four gradient units in operation were taken in the equatorial plane of the cylinder, $\alpha$ response, and in the two polar planes defined by $\alpha=0$ and $\alpha=90°$, $\theta$ and $\theta'$ responses, respectively. The angles $\alpha$, $\theta$, and $\theta'$ relative to the system are indicated in FIG. 1.

Figure 4:
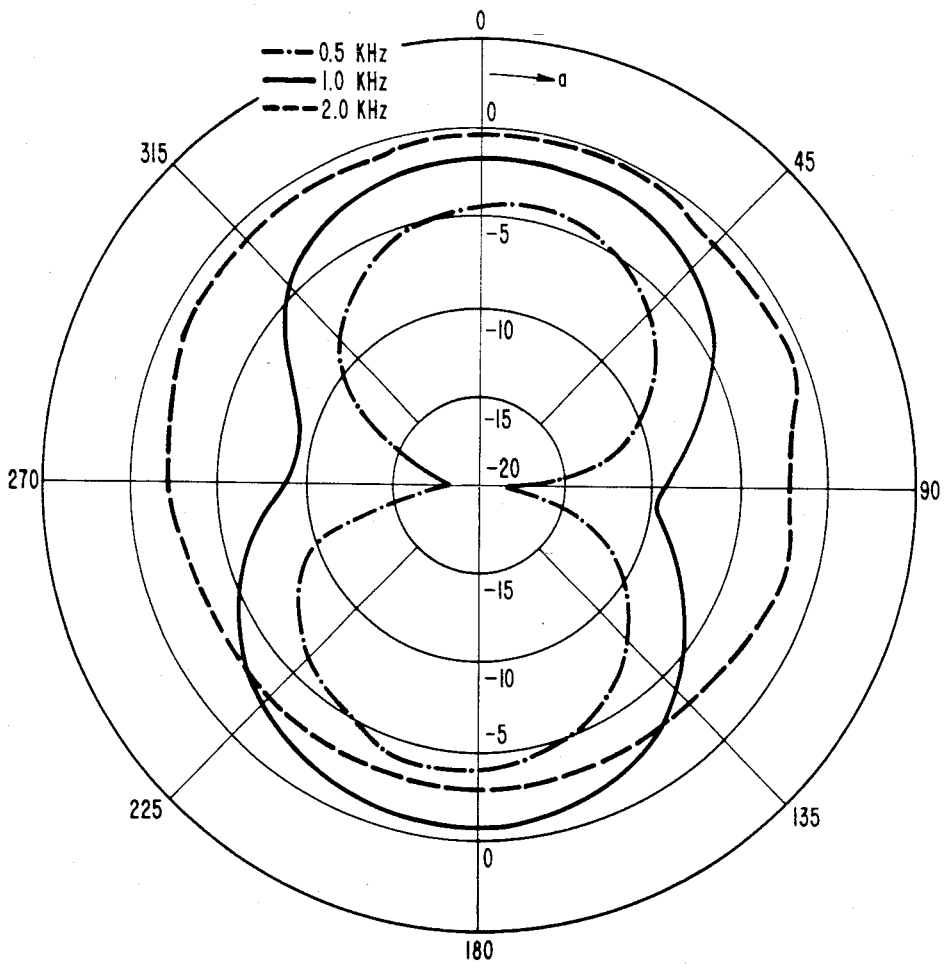
FIGS. 4 and 5 show response patterns for the arrangement of FIG. 1 when only one microphone is operational.
Figure 5:
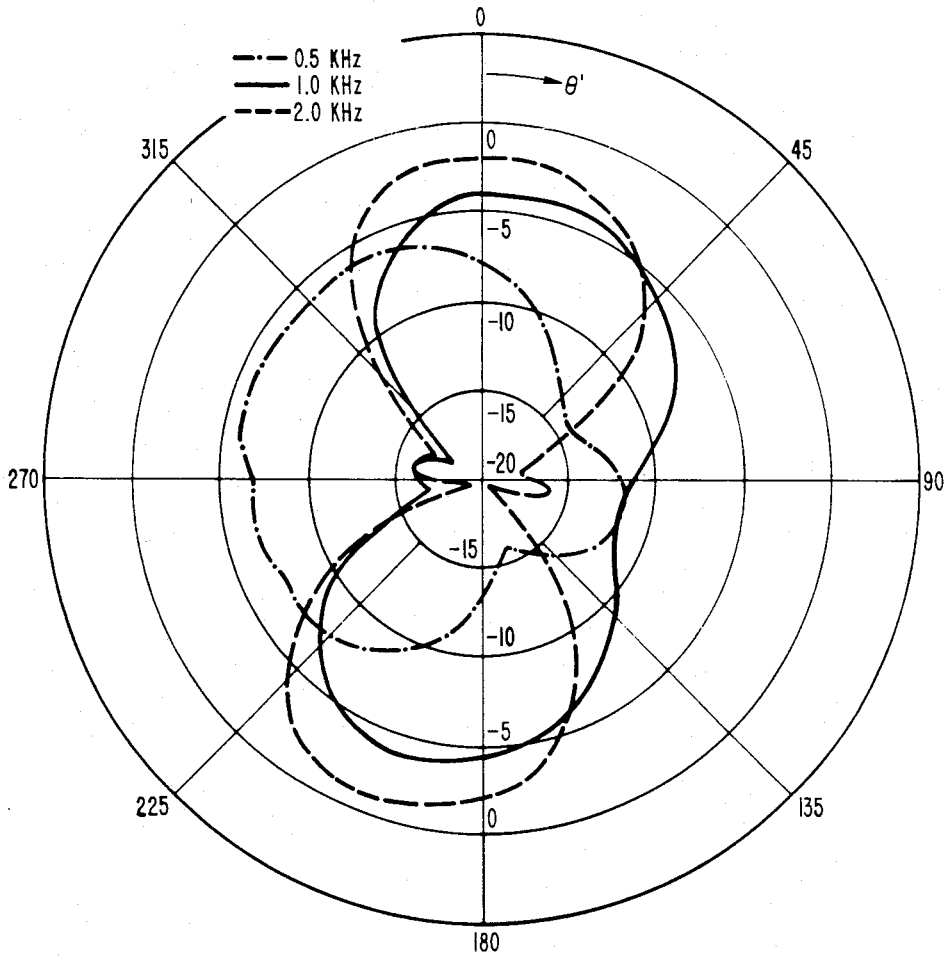

The $\alpha$ and $\theta'$ responses of the system, utilizing the cylinder of height H=5 cm, with only gradient microphone 18 (12, 14, or 16) in operation, are shown in FIGS. 4 and 5, respectively. The $\alpha$ responses in FIG. 4 show the cosine pattern expected for an unbaffled gradient only at low frequencies. At 2 kHz, the response is rather uniform. Here, the "inner" opening of the microphone is already partially shielded by the cylinder while the "outer" opening receives sound for all angles, due to the presence of the circumferential wave, provided no standing wave pattern develops. The system thus acts as a combination of a gradient transducer of relatively small sensitivity and an omnidirectional transducer of larger sensitivity, which together yield a distorted spherical response. At certain frequencies, the circumferential wave causes a standing wave pattern around the cylinder. Because of the dispersion expressed by equation (5), these frequencies are not harmonics. For these frequencies a non uniform $\alpha$ response is expected.

The $\theta'$ responses in FIG. 5, axis of the active gradient microphone 18 parallel to the rotational axis, show high sensitivity for $\theta'=0°$ and for $\theta'=180°$, due to the shading of the inner microphone openings by cylinder 10. Lower sensitivity is obtained for $\theta'=90°$ and for $\theta'=270°$. The directivity increases with increasing frequency and surpasses that of a cosine squared, ($\cos^2$), law at about 1 kHz.

Figure 6:
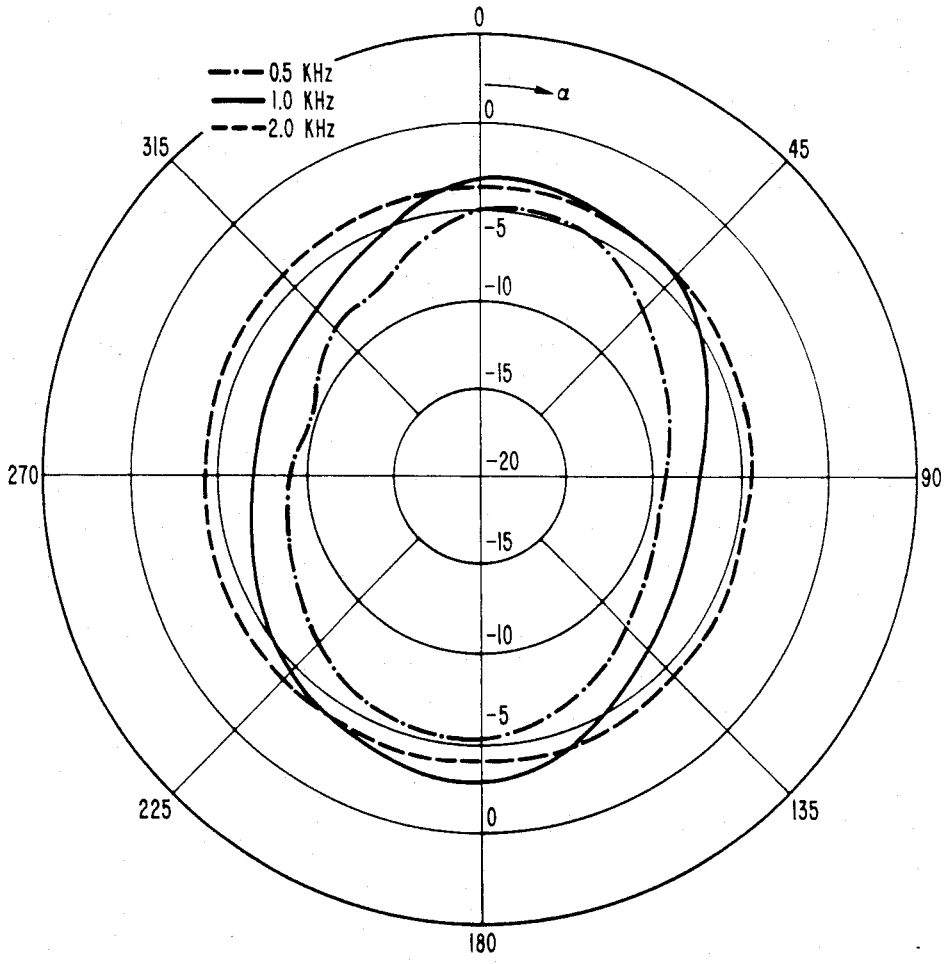
FIGS. 6. 7 and 8 show response patterns when only two of the microphones are operational.
Figure 7:
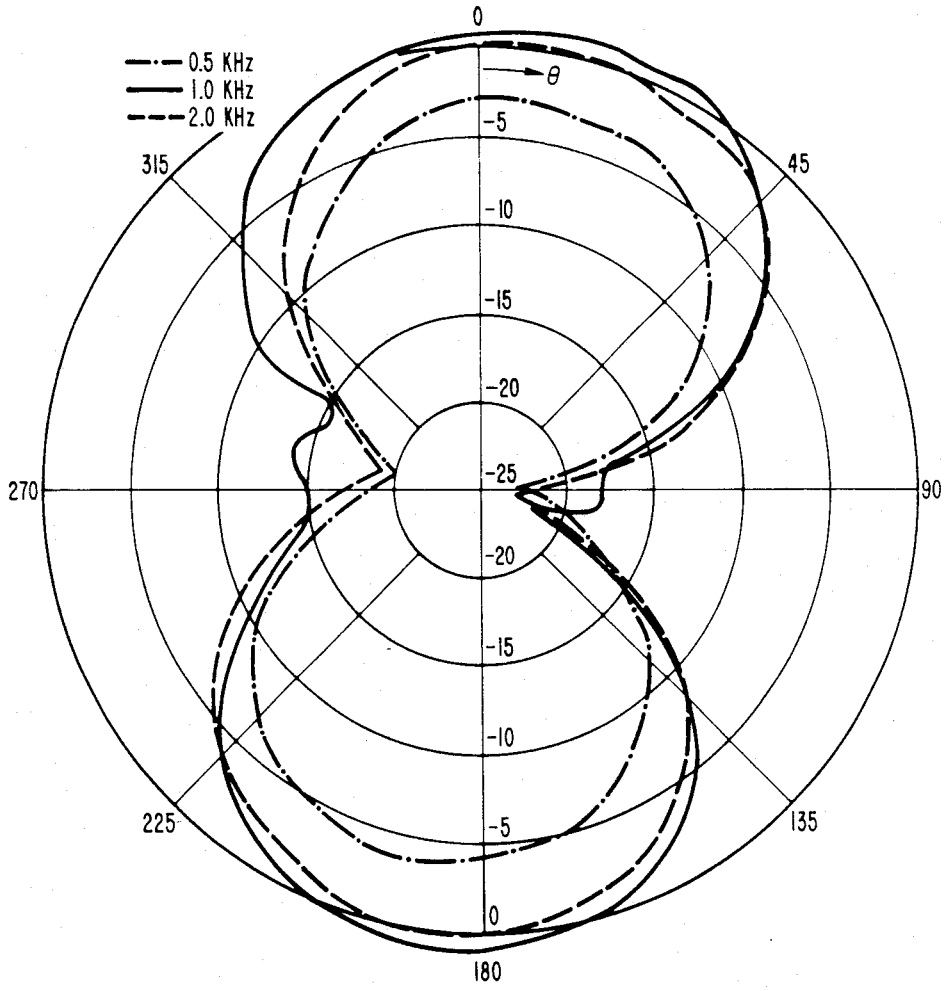
Figure 8:
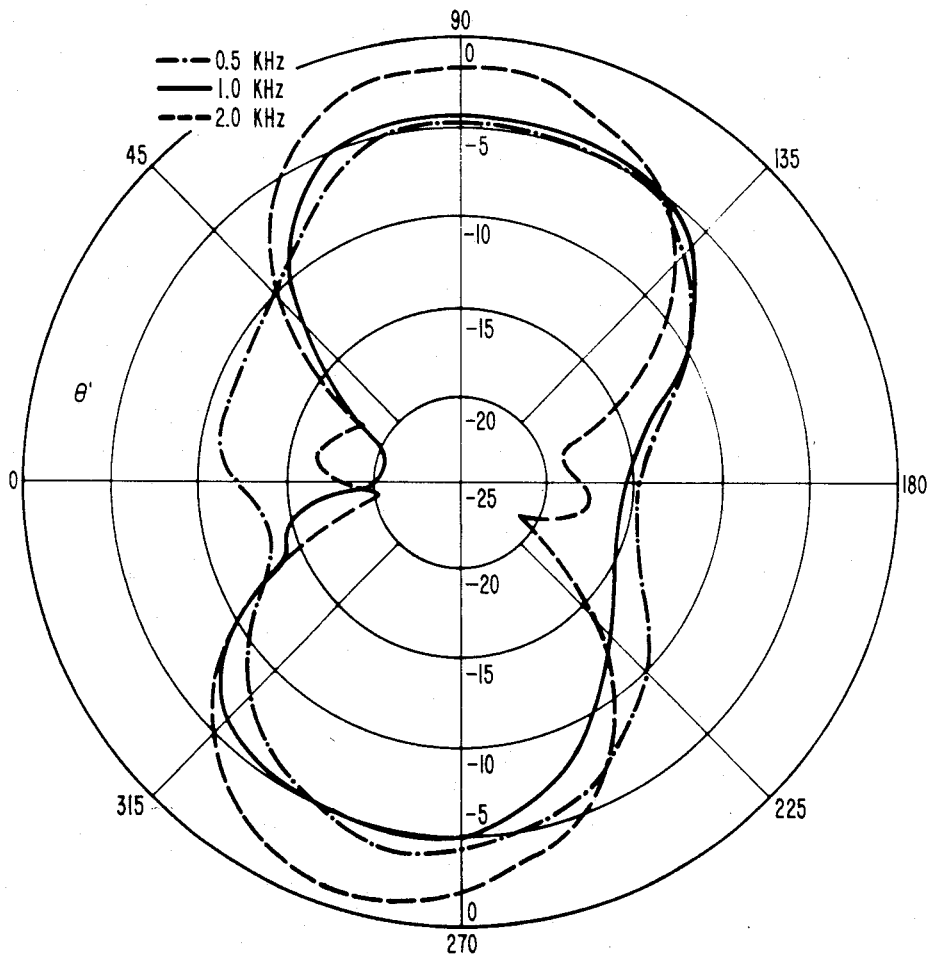

If the opposing gradient units 14 and 18 (or, 12 and 16) are activated, the responses shown in FIGS. 6, 7 and 8 are obtained. The $\alpha$ responses in FIG. 6 are now somewhat more uniform than with only a single unit in operation. The equalizing effect of the circumferential waves is clearly evident.

The $\theta$ responses at 1 kHz and 2 kHz in FIG. 7 show the $\cos^2$ pattern expected for an unbaffled linear second order gradient. In particular, the responses are down by about 12 dB at $\pm 60°$ from the direction of maximum sensitivity and by 15 dB to 25 dB in the $\pm 90°$ directions. The close adherence to the $\cos^2$ law is surprising in view of the fact that the cylinder modifies the sound waves incident on the various sensors in different ways. At 500 Hz, the response deviates somewhat from this behavior.

The $\theta'$ responses in FIG. 8 are similar to those of a single unit shown in FIG. 5. Again, the directivity increases with increasing frequency.

Figure 9:
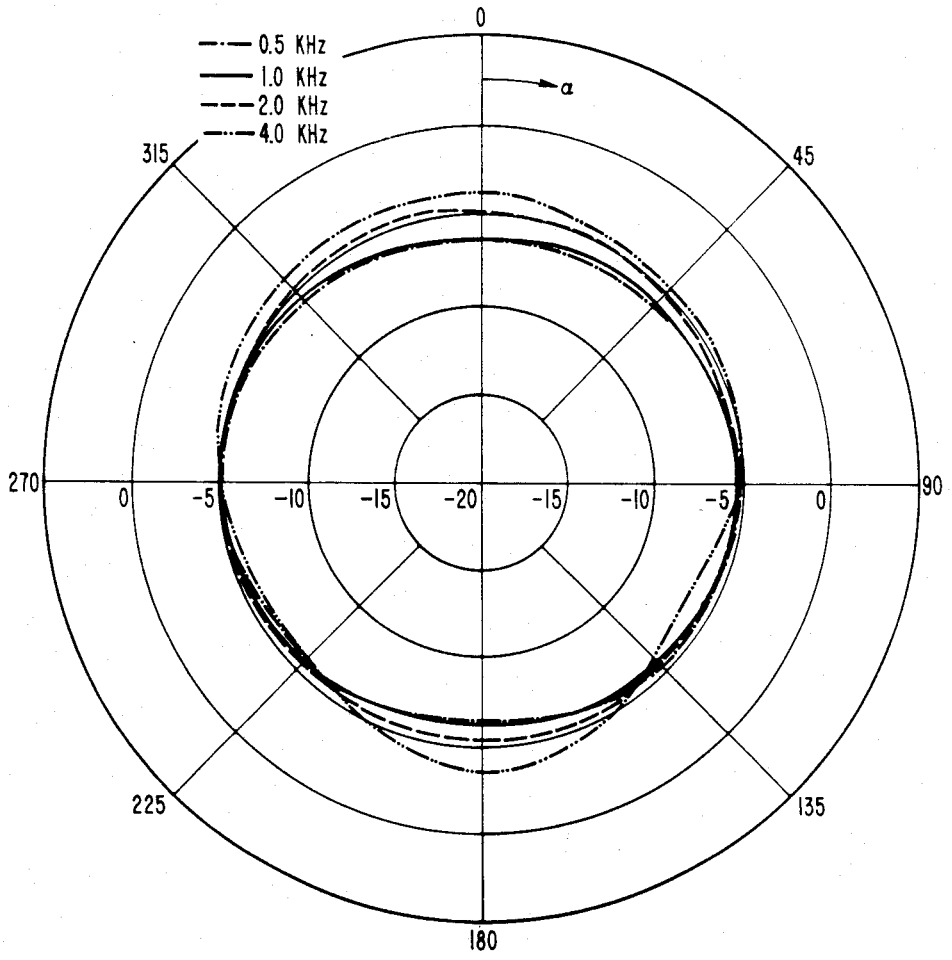
FIGS. 9, 10 and 11 show response patterns when all the microphones are operational.
Figure 10:
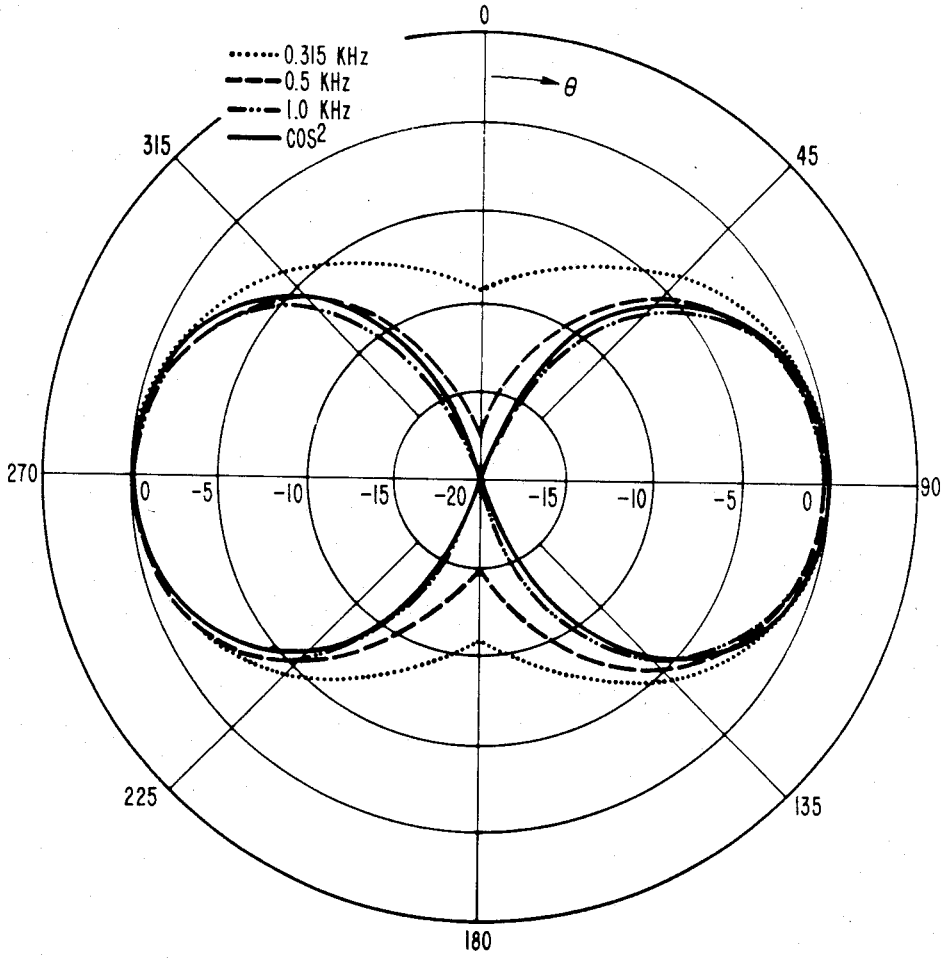
Figure 11:
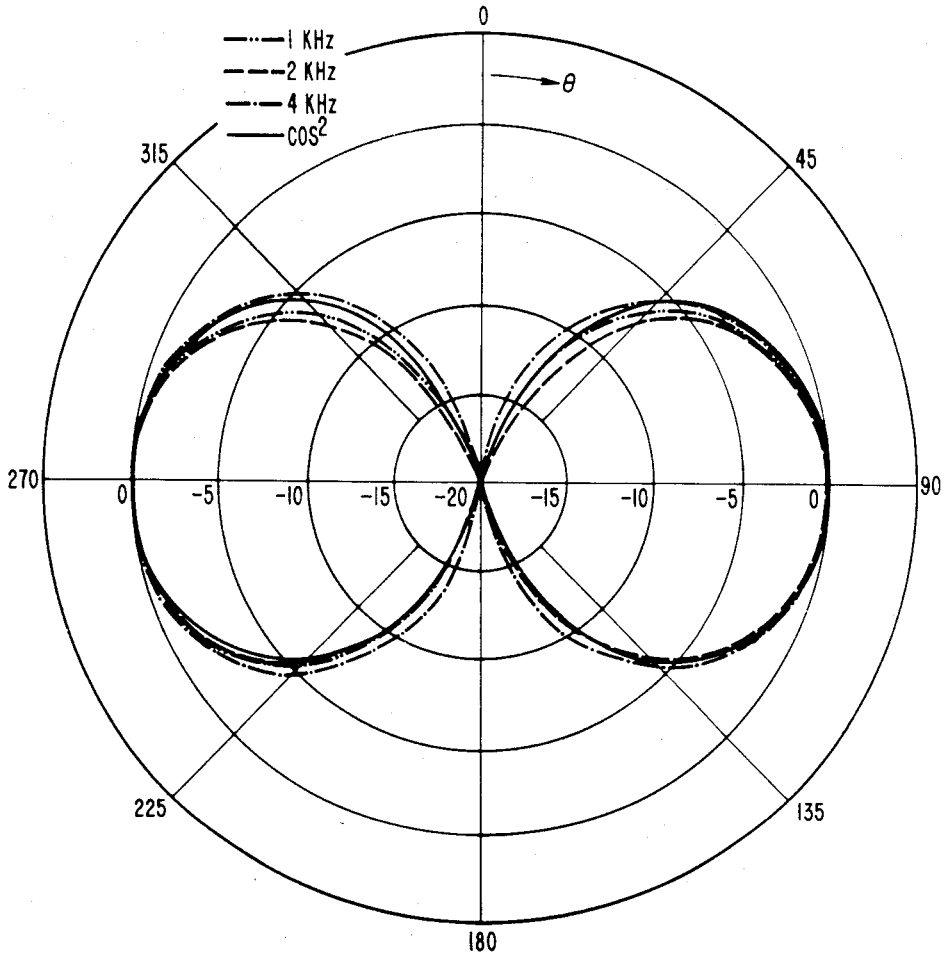

When all gradient microphones are activated, the responses illustrated in FIGS. 9 through 11 are found. The $\alpha$, equatorial, responses in FIG. 9 are rather uniform. Deviations from the average values are less than $\pm 1.5$ dB. This uniformity is due to the fact that the circumferential waves around the cylinder tend to equalize the equatorial response, as already seen for one and two operating microphones in FIGS. 4 and 6, respectively. With four operating gradients, the resulting responses are, of course, even more uniform.

The $\theta$ responses at low and high frequencies, shown in FIGS. 10 and 11, respectively, follow closely the $\cos^2$ law for frequencies of 1 kHz and above, as shown by the solid line. At 500 Hz and below, these patterns are less directional. The 3 dB width at 1 kHz is about $\pm 30°$, in close agreement with the value of $\pm 33°$ obtained for the $\cos^2$ characteristic. The responses can be viewed as a superposition of the $\theta$ and $\theta'$ records of the system with only two active gradients, as shown in FIGS. 7 and 8. Thus, the full unit draws part of its $\theta$ response from the gradient microphones 12 and 16 which would yield a vanishing $\theta$ response in an unbaffled arrangement. The very pronounced directivity of the $\theta$ response of this combination of microphones 14 and 16 at 2 kHz thus accounts for the better than $\cos^2$ directivity of the full system at this frequency.

Figure 12:
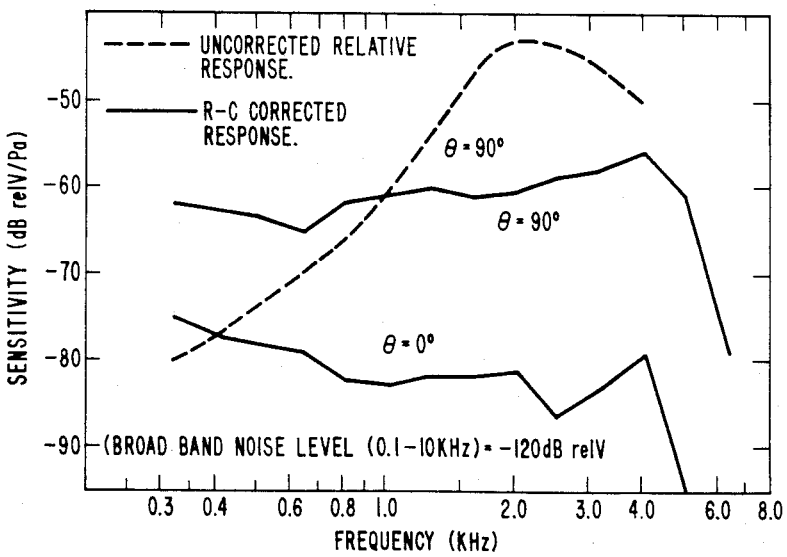
FIG. 12 compares the response patterns for the arrangement of FIG. 1 between compensated and uncompensated systems.

Plots of the frequency responses of the full system for $\alpha=\theta=0$ are shown in FIG. 12. Without correction, the system has a response that rises more than proportional with $\omega^2$ as explained above (illustrated by the curve with broken lines). Also shown in FIG. 12, is the response obtained by using a second order RC low pass filter, with a cut off frequency of 150 Hz, at the output of the system (circuit not shown). This response rises by about 6 dB from 300 Hz to 2000 Hz and is thus within the limits specified for telephone receivers. The pre-emphasis at mid frequencies is actually desirable in many applications. If necessary, it could be fully or partially removed electronically.

The sensitivity of the compensated microphone at 1 kHz is $-60$ dBV/Pa while the equivalent noise level, measured in the frequency band from 0.3 to 10 kHz, is $-120$ dB re IV. This corresponds to an equivalent sound pressure level of 34 dB. The noise is largely due to the emitter followers which are part of each of the gradient microphones.

Figure 13:
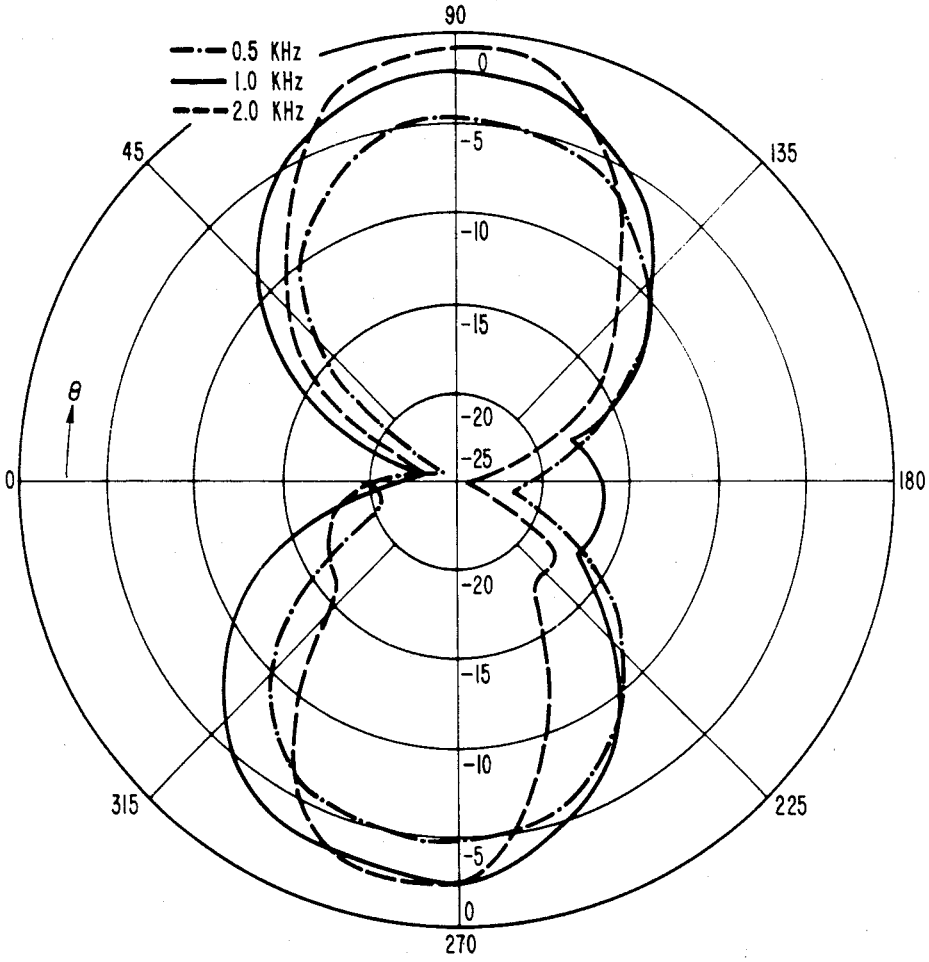
FIG. 13 shows that the response pattern for the toroidal system can be made more strongly directional by increasing the height of the cylinder.

As pointed out above, a more pronounced directional pattern is obtained by lengthening the cylinder. This is illustrated in FIG. 13, which shows the $\theta$ response of a system with a cylinder of 15 cm height. The 3 dB width at 2 kHz is now about $\pm 20°$, as compared to $\pm 33°$ for the $\cos^2$ characteristic. This system has, of course, a more pronounced frequency dependence of the sensitivity.

What is claimed is:

1. A directional microphone arrangement comprising a hollow cylindrical wall having an outer surface and an inner surface and open ends, a plurality of pressure gradient electroacoustic transducers each having first and second sides determining a prescribed directional polarity, the dimensions of said transducer being small in relation to the dimensions of said cylindrical wall, said transducers being mounted in said wall in symmetrical relationship, each transducer having its first side on said outer surface and its second side on said inner surface, and means for summing the outputs of said transducers to produce a toroidal shape directional response pattern about the axis of rotation of said hollow cylindrical wall.

2. A microphone arrangement comprising a plurality of microphones, means for housing said microphones symmetrically, means for summing the signals from said microphones to produce an output, said output describing a toroidal response pattern which is substantially uniform around said arrangement.

3. The microphone arrangement of claim 2 wherein said microphones are pressure gradient, bidirectional microphones each having first and second surfaces.

4. The microphone arrangement of claim 3 wherein said housing means comprises a cylindrical, thin walled baffle having inner and outer surfaces which are concentric about a central axis.

5. The microphone arrangement of claim 4 wherein said housing means further comprises a plurality of symmetrically located recesses through said wall for receiving said microphones so that the angle between any two of said microphones and said axis is the same in a plane perpendicular to said axis.

6. The microphone arrangement of claim 5 wherein the distance between the top of any of said microphones and the top of said baffle equals the distance between the bottom of any of said microphones and the bottom of said baffle.

7. The microphone arrangement of claim 6 wherein said distance is used to control the spacing between said first and second surfaces of said microphones so as to control the sensitivity of said microphone arrangement and the directivity of the response pattern of said arrangement.

8. The microphone arrangement of claim 7 wherein said microphones are electret microphones.

9. A method of producing a toroidal sensitivity pattern from a microphone arrangement comprising the steps of placing a plurality of first order pressure gradient electret microphones symmetrically within recesses through a wall of a hollow cylindrical baffle having first and second surfaces which are concentric about a central axis so that the angular spacing between any two of said microphones and said axis is equal in a plane perpendicular to said axis, locating said recesses so that the distance between the tops of each of said microphones and the top of said baffle equals the distance between the bottoms of each of said microphones and the bottom of the baffle, and summing the signals from said microphones to produce said toroidal sensitivity pattern.

* * * * *